United States Patent [19]

Seisz et al.

[11] Patent Number: 5,013,261

[45] Date of Patent: May 7, 1991

[54] DEVICE FOR CONNECTING A COAXIAL CABLE

[75] Inventors: Michael Seisz, Herrieden; Roland Knauf; Dieter Schwarz, both of Nuremberg; Hans-Jürgen Weidner, Winkelhaid, all of Fed. Rep. of Germany

[73] Assignee: U.S. Philips Corporation, New York, N.Y.

[21] Appl. No.: 449,663

[22] Filed: Dec. 12, 1989

[30] Foreign Application Priority Data

Dec. 16, 1988 [DE] Fed. Rep. of Germany ..... 3842406

[51] Int. Cl.[5] ..... H01R 17/18

[52] U.S. Cl. ..... 439/581; 439/841; 439/63

[58] Field of Search ..... 439/578–585, 439/98, 99, 607, 610, 63, 507, 510, 512, 513, 514, 92, 840, 841

[56] References Cited

U.S. PATENT DOCUMENTS

| | | | |
|---|---|---|---|
| 3,761,844 | 9/1973 | Reeder | 439/578 |
| 4,396,244 | 8/1983 | Teman | 439/507 |
| 4,453,798 | 6/1984 | Asick et al. | 439/581 |
| 4,494,816 | 1/1985 | Tamburro | 439/581 |
| 4,656,441 | 4/1987 | Takahashi et al. | 439/63 |
| 4,875,865 | 10/1989 | Demler et al. | 439/578 |

FOREIGN PATENT DOCUMENTS

| | | | |
|---|---|---|---|
| 0031869 | 7/1981 | European Pat. Off. . | |
| 3516507 | 11/1986 | Fed. Rep. of Germany . | |
| 2104312 | 3/1983 | United Kingdom | 439/63 |

*Primary Examiner*—David L. Pirlot
*Attorney, Agent, or Firm*—William Squire

[57] ABSTRACT

A planar good electrical conductor part, having a connection lug connects to the outer conductor of a coaxial cable. The part has near its circumference an annular array of through-holes through which contact pins can be passed and brought into contact with the part. A central contact pin can be passed through a recess arranged approximately in the center of the part and can be brought into contact with the inner conductor of the coaxial cable secured to the part by the lug and aligned with the central recess.

6 Claims, 2 Drawing Sheets

DEVICE FOR CONNECTING A COAXIAL CABLE

The invention concerns a device for connecting the inner and outer conductor of a coaxial cable to contact pins.

Such devices are, for example, used in telecommunications equipment. In this respect, connections of coaxial cables are also required to, for example, a female or male connector, arranged on a printed-circuit board, of a multipoint connector. With known, so-called snap-in inserts, parts of the multipoint connector can be replaced with coaxial connectors consisting of coaxial plugs and coaxial sockets. Such multipoint connectors with snap-in inserts represent an essential cost factor. From EP-A 31 869 a transition is known from a coaxial cable to a multipoint connector. The transition consists of a coplanar wall line with a conductor strip which is surrounded by a conductive surface. The inner conductor of the coaxial cable is brought into contact with one end of the conductive strip and the outer conductor is brought into contact with the conductive surface of the strip line at least at one place. The other end of the conductive strip is connected to one pin of the multipoint connector. At least one adjacent pin is connected to the conductive surface of the strip line.

It is an object of the invention to provide a device of the type indicated at the beginning which makes possible an electrically secure connection of a coaxial cable, in particular to contact pins of a female or male connector, arranged, for example, on a printed-circuit board, which can be simply and economically manufactured and has good electrical properties in respect of coaxial signal routing.

The object is achieved in a device of the type indicated at the beginning in that the device has an essentially planar part of a material which is a good electrical conductor, having a connection lug for connecting the outer conductor, the part having through-holes near the circumference, through which first contact pins can be passed and brought into contact with the part and it being possible to pass a second contact pin through a recess arranged approximately in the center of the part and to bring it into contact with the inner conductor of the coaxial cable.

Advantageous embodiments are contained in the subclaims.

The invention will be explained in greater detail with reference to the exemplary embodiments represented diagrammatically in the figures.

Figure 1:
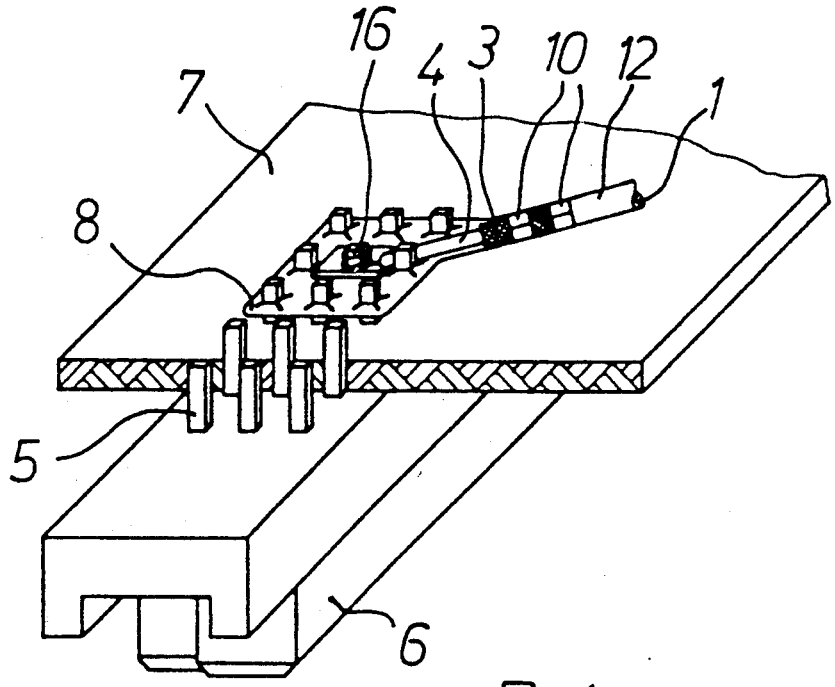
FIG. 1 shows an isometric representation partially in section of a multipoint connector arranged on a printed-circuit board, having a device for the connection of a coaxial cable.
Figure 2:
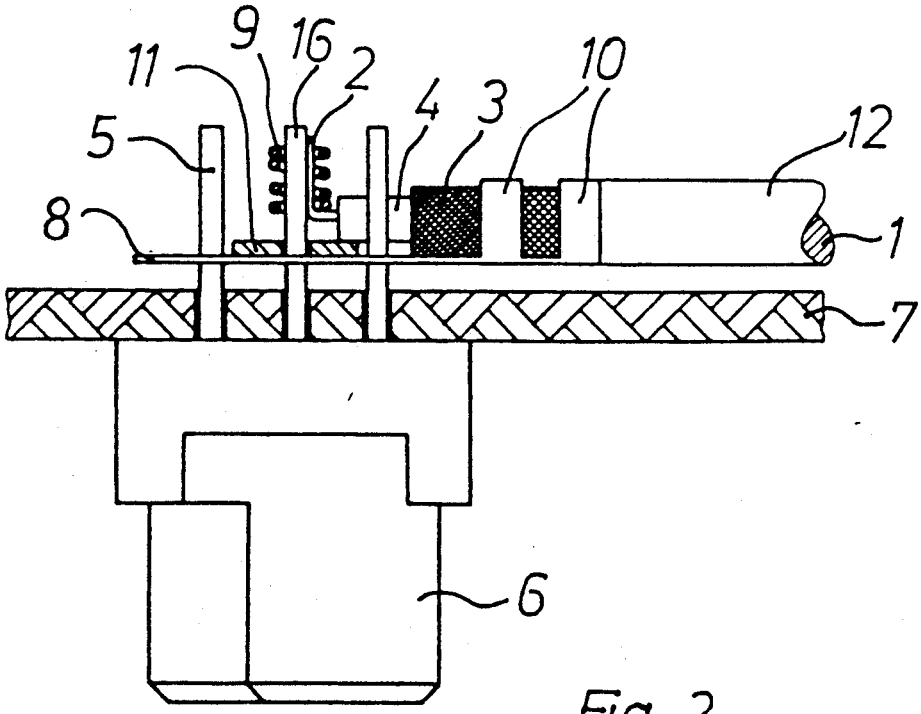
FIG. 2 shows partially in section the arrangement of FIG. 1 in a side view.
Figure 3:
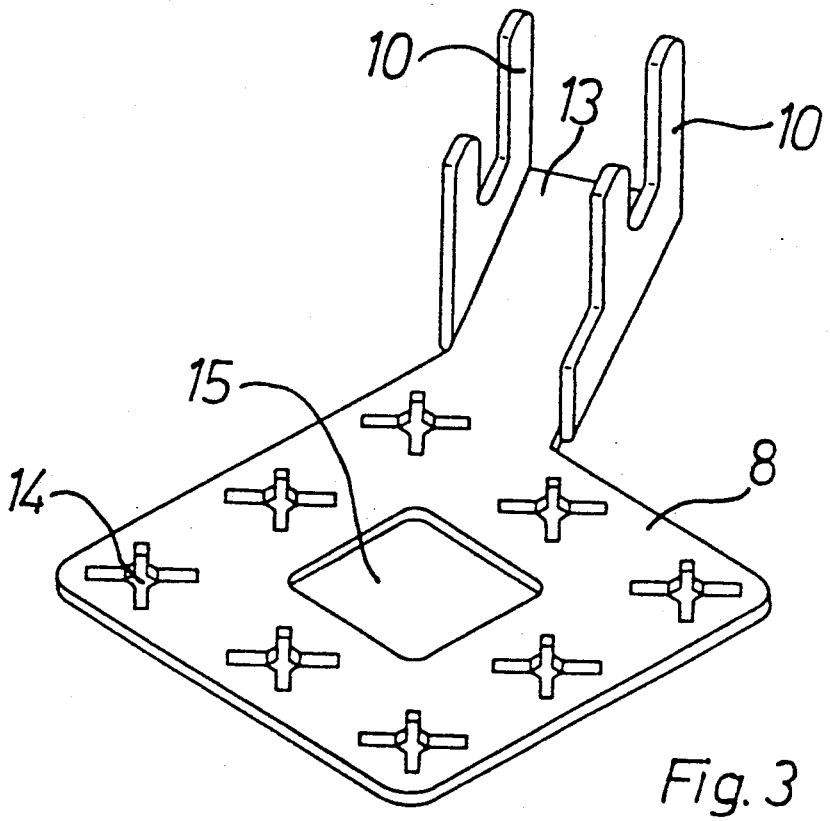
FIG. 3 shows a detailed isometric representation of a device for the connection of a coaxial cable.

The device represented in FIGS. 1 to 3, for connecting an inner conductor 2 and an outer conductor 3 of a coaxial cable 1 to the female or male connector of a multipoint connector 6 arranged on a printed-circuit board 7 comprises a planar part 8 of material which is a good electrical conductor. The part 8 FIG. 3, has a connection lug 13 provided with clamping tonas 10, to which connection lug the end of the outer conductor 3 freed from the cable sheath 12, in the exemplary embodiment represented in FIGS. 1 and 2, is clamped tight and soldered on in a known way. In a further exemplary embodiment, the connection of the outer conductor to the connection lug is made with the aid of a ferrule (not shown). The part 8 has adjacent to its circumference through-holes 14 which are designed in correspondence with the arrangement pattern of contact pins 5 arranged on the printed-circuit board 7. The through-holes 14 are constructed in the exemplary embodiment represented in FIGS. 1 to 3 as terminal contacts and are made in the part 8 which is produced from spring steel, for example by etching. In the exemplary embodiment represented in FIGS. 1 and 2, contact pins 5 which are arranged on a female or male multipoint connector 6 are passed through the through-holes 14 and electrically and mechanically connected to the part 8 by the clamping effect by the edges of part 8 at holes 14. The part 8 has arranged approximately in its center a further recess 15, through which a central contact pin 16 is passed to the female or male multipoint connector 6. The central contact pin 16 is connected to the end, which has been freed from the intermediate insulation 4, of the inner conductor 2 of the coaxial cable 1, for example by means of a solder spring 9 or by means of a locking sleeve. In the exemplary embodiment represented in FIGS. 1 and 2, the end of the central contact pin 16 projecting out from the part 8 is passed through an insulating disk 11 for the prevention of short circuits. To obtain a desired distance between the part 8 and the printed-circuit board 7, between the printed-circuit board and part 8 a correspondingly constructed spacing piece (not shown) can be inserted. Contact pins 5 already known from press-in systems are especially suitable, since these are constructed to be thicker in their lower region.

The device represented in FIGS. 1 to 3 thus provides a simple, cost-effective and electrically secure connection of a coaxial cable to contact pins, in particular of a female or male connector, arranged, for example, on a printed-circuit board, of a multipoint connector. The multipoint connector enables contact to be made in an easily detachable manner to a corresponding multipoint connector. Due to the arrangement pattern of the through-holes 14 of the part 8, this device has good electrical properties in respect of coaxial signal routing. Moreover, the possibility is created of realizing the coaxial cable connection together with other cables, for example via the female connector, represented in FIGS. 1 and 2, of a multipoint connector 6 for example within a common cable harness.

Figure 4:
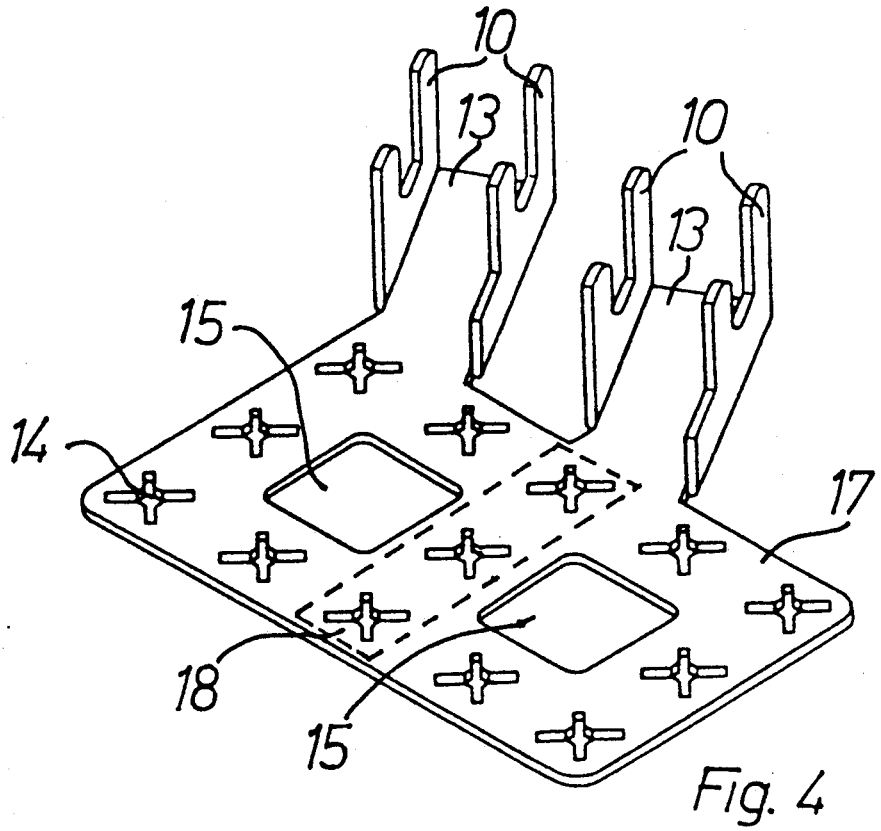
FIG. 4 shows as a further exemplary embodiment an isometric representation of a device for the connection of two coaxial cables.

In addition to the exemplary embodiment represented in FIG. 3, other embodiments are conceivable, in particular for multiple coaxial connections. Thus, for example, in FIG. 4 a device for connecting two coaxial cables is represented.

A planar part 17 is constructed approximately corresponding to two adjacent parts 8 of the exemplary embodiment represented in FIG. 3, only one central row 18 of holes 14 being provided in order to save space. The part 17 has two connection lugs 13 with corresponding tangs 10 for connecting the outer conductors of the coaxial cables and is provided with through-holes 14 which are arranged according to the arrangement pattern of the contact pins 5 of the female connector 6 represented in FIGS. 1 and 2. The central contact pins can be passed through two recesses 15 of the part 17, which are in each case arranged in the centre of the through-holes 14, according to the exemplary embodiment represented in FIGS. 1 and 2 and can be brought into contact with the inner conductor of the coaxial cable.

What is claimed is:

1. A device for connecting the inner and outer conductors of a coaxial cable to contact pins in a given array, said device comprising:

a planar electrical conductor having an array of first apertures therethrough oriented in said given array for receiving and electrically coupling said pins thereto and a second aperture dimensioned for receiving a pin therethrough in electrical isolation; and an electrically conductive U-shaped lug member having a base wall and two upstanding walls, said base wall being coplanar with said planar conductor, said member being secured to the planar conductor and arranged to electrically couple and secure said outer conductor thereto in a given orientation with said inner conductor aligned with said second aperture.

2. The device of claim 1 further including an insulating disk secured juxtaposed with said second aperture.

3. The device of claim 1 further including a connector including said given array of contact pins and a center pin, at least a portion of said given array of pins each passing through a different first aperture in electrical conductive contact with said planar conductor, said center pin passing through said second aperture electrically isolated from said planar conductor and adapted to be secured to said coaxial inner conductor.

4. The device of claim 1 wherein said planar member and lug are formed from a common sheet of spring steel.

5. The device of claim 4 wherein said first and second apertures are formed by etching.

6. A device for connecting the inner and outer conductors of a plurality of coaxial cables to a plurality of contact pins secured to a connector in a given array, said device comprising:

a planar electrical conductor having a plurality of annular arrays of first apertures therethrough oriented for receiving and electrically coupling said pins thereto and a plurality of second apertures each dimensioned for receiving a pin therethrough in electrical isolation relative to said planar conductor; each second aperture being located substantially centrally in a different one of said annular arrays; and a plurality of electrically conductive lug members secured to the planar conductor and arranged to electrically couple and secure said outer conductor thereto in a given orientation with said inner conductor aligned with a second aperture, each lug member corresponding to a different annular array.

* * * * *